US009864315B2

(12) United States Patent
Baba et al.

(10) Patent No.: US 9,864,315 B2
(45) Date of Patent: Jan. 9, 2018

(54) IMAGE FORMING APPARATUS

(71) Applicant: FUJI XEROX CO., LTD., Tokyo (JP)

(72) Inventors: Motofumi Baba, Kanagawa (JP); Yoshihiko Nemoto, Kanagawa (JP); Hidekiyo Tachibana, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/923,890

(22) Filed: Oct. 27, 2015

(65) Prior Publication Data

US 2016/0216671 A1 Jul. 28, 2016

(30) Foreign Application Priority Data

Jan. 22, 2015 (JP) ..... 2015-010647

(51) Int. Cl.
*G03G 15/00* (2006.01)

(52) U.S. Cl.
CPC ..... *G03G 15/55* (2013.01); *G03G 15/5091* (2013.01); *G03G 2215/0132* (2013.01)

(58) Field of Classification Search
CPC ..... G03G 15/55
See application file for complete search history.

(56) References Cited

U.S. PATENT DOCUMENTS 6,583,813 B1 * 6/2003 Enright ..... G06Q 20/18 348/143
2006/0261931 A1 * 11/2006 Cheng ..... B60R 25/102 340/426.1
2008/0010079 A1 * 1/2008 Genda ..... H04N 1/00326 358/1.15
2009/0167493 A1 * 7/2009 Colciago ..... E05G 5/003 340/5.83
2014/0305352 A1 * 10/2014 Dowling ..... G07C 9/00031 109/38

FOREIGN PATENT DOCUMENTS

JP 2010-233145 A 10/2010

* cited by examiner

*Primary Examiner* — Ryan Walsh
(74) *Attorney, Agent, or Firm* — Oliff PLC

(57) ABSTRACT

Provided is an image forming apparatus including an image forming unit that forms an image on a recording material, an image capturing unit that captures an image of a user who forms the image, and a control unit that causes the image capturing unit to capture an image in a preset monitoring region when the user does not capture an image using the image capturing unit.

15 Claims, 7 Drawing Sheets

IMAGE FORMING APPARATUS

CROSS-REFERENCE TO RELATED APPLICATIONS

This application is based on and claims priority under 35 USC 119 from Japanese Patent Application No. 2015-010647 filed Jan. 22, 2015.

BACKGROUND (i) Technical Field

The present invention relates to an image forming apparatus.

(ii) Related Art

In the related art, a monitoring apparatus is known in which a predetermined monitoring region is set, and an inside of the monitoring region is captured by a monitoring camera. In this case, for example, an image captured by the monitoring camera is transmitted to a monitoring center through a public communication network, or the like, and the monitoring center may check a state of the monitoring region when abnormality is generated.

SUMMARY

According to an aspect of the invention, there is provided an image forming apparatus including:

an image forming unit that forms an image on a recording material;

an image capturing unit that captures an image of a user who forms the image; and a control unit that causes the image capturing unit to capture an image in a preset monitoring region when the user does not capture an image using the image capturing unit.

BRIEF DESCRIPTION OF THE DRAWINGS

Exemplary embodiments of the present invention will be described in detail based on the following figures, wherein.

DETAILED DESCRIPTION

Description of Entire Image Forming Apparatus

Hereinafter, with reference to attached drawings, exemplary embodiments will be described in detail.

Figure 1:
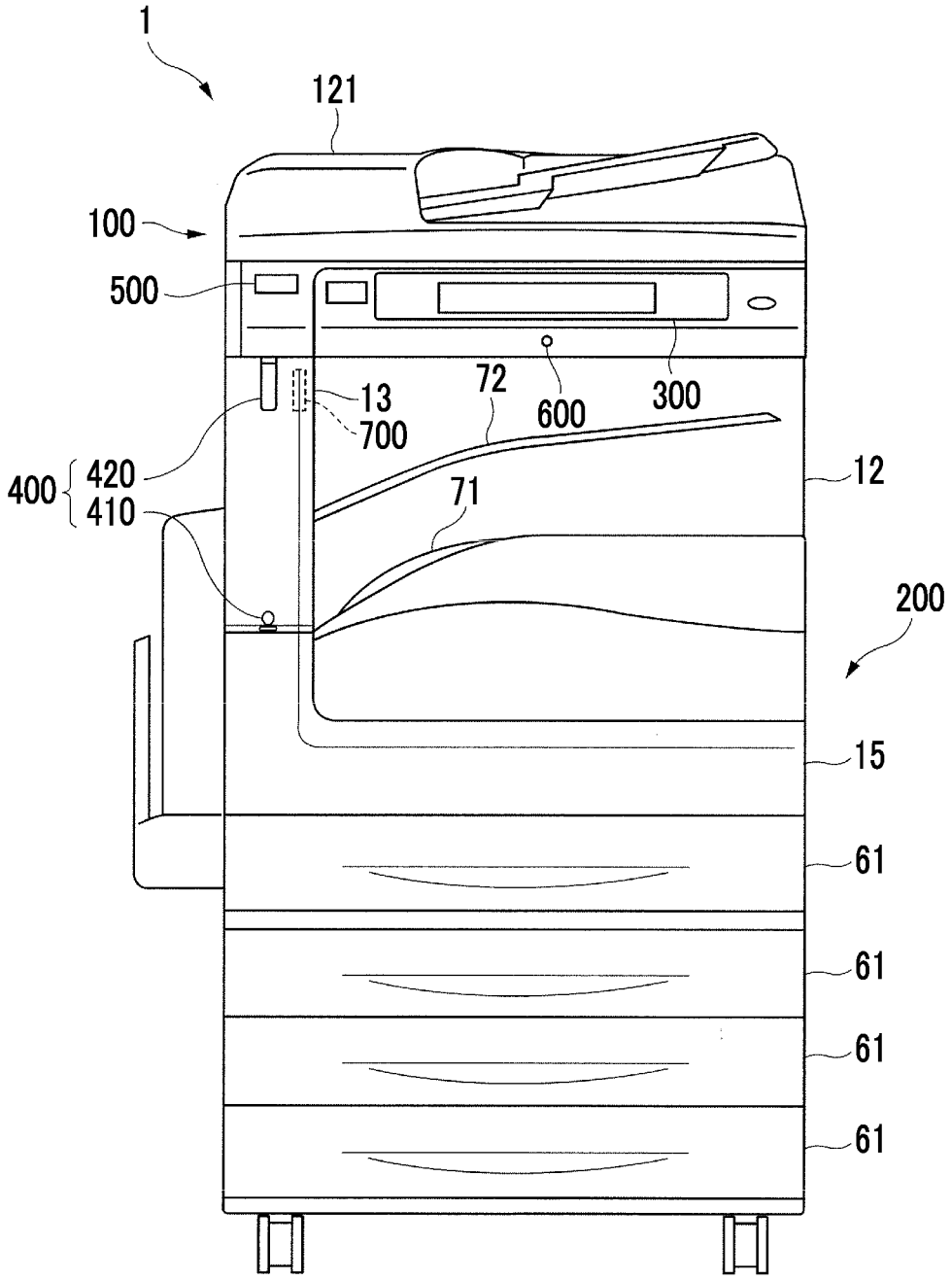
FIG. 1 is an exterior view of an image forming apparatus according to an exemplary embodiment.
Figure 2:
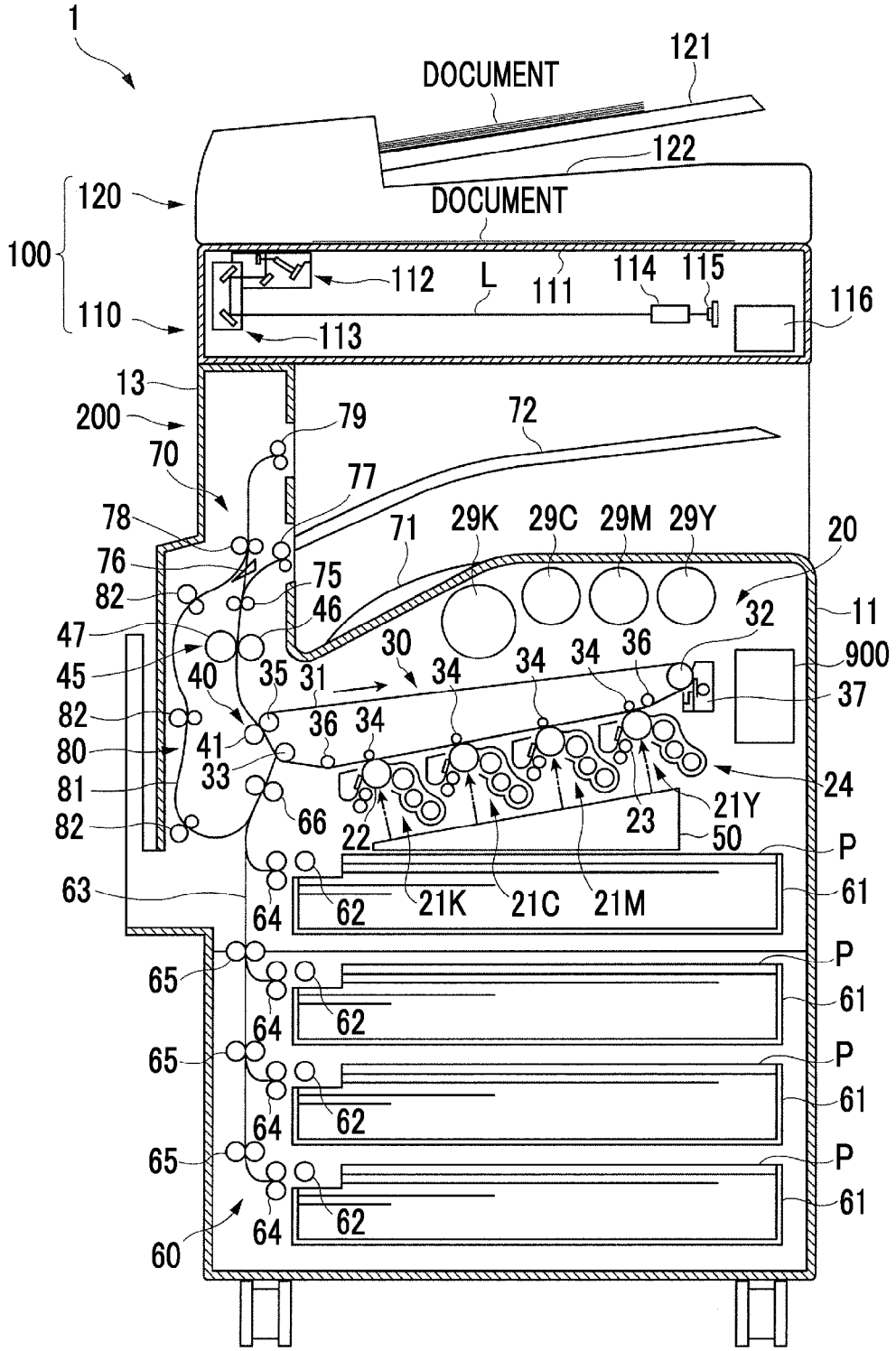
FIG. 2 is a view illustrating an inner structure of the image forming apparatus according to the exemplary embodiment.

FIG. 1 is an exterior view of an image forming apparatus 1 according to the exemplary embodiment. FIG. 2 is a view illustrating an inner structure of the image forming apparatus 1 according to the exemplary embodiment.

As illustrated in FIG. 1, the image forming apparatus 1 includes an image reading device 100 which reads an image of the document and an image recording device 200 as an example of an image forming means which forms an image on a recording material (hereinafter, there is a case in which the recording material is representatively referred to as "paper".). In addition, the image forming apparatus 1 includes a user interface (UI) 300 which receives an operation input from a user or displays various information with respect to the user.

Further, the image forming apparatus 1 includes a human detecting sensor 400 which detects human, a camera 500 which captures an image of vicinity of the image forming apparatus 1, a microphone 600 which acquires sound, and a speaker 700 which outputs the sound. Further, as illustrated in FIG. 2, in the image forming apparatus 1, a control device 900 which controls an operation of the entire image forming apparatus 1.

As illustrated in FIG. 1, the image reading device 100 is disposed on an upper portion of the image forming apparatus 1, and the image recording device 200 is disposed below the image reading device 100. The user interface 300 is disposed at a front side of an upper portion of the image forming apparatus 1, that is, disposed at a front side of an image reading section 110 (to be described later) of the image reading device 100.

In addition, the human detecting sensor 400 is disposed at a front side of a reading device supporting section 13 to be described later. Further, the camera 500 is disposed at a left side of the user interface 300, and the microphone 600 is disposed at a front side of the user interface 300. Also, the speaker 700 is disposed at a right side of the reading device supporting section 13.

The image reading device 100 will be described.

As illustrated in FIG. 2, the image reading device 100 includes the image reading section 110 which functions as an image reading means reading an image of the document and a document transporting section 120 which transports the document to the image reading section 110. The document transporting section 120 is disposed on an upper portion of the image reading device 100, and the image reading section 110 is disposed on a lower portion of the image reading device 100.

The document transporting section 120 includes a document accommodating section 121 which accommodates the document and a document outputting section 122 which outputs the document transported from the document accommodating section 121. The document transporting section 120 transports the document from the document accommodating section 121 to the document outputting section 122. The document transporting section 120 is provided so as to be possible to open and close with a hinge (not illustrated) as a center, and the hinge is provided in an inner side of the image forming apparatus 1 in the drawing. When opening the document transporting section 120, a platen glass 111 provided in the image reading section 110 appears.

The image reading section 110 includes the platen glass 111, a light projecting unit 112 as a light source for reading an image which applies light to a surface to be read (image surface) of the document, a light guiding unit 113 which guides light L reflected on the surface to be read of the document to which the light L from the light projecting unit 112 is applied, and an image forming lens 114 which forms an optical image of the light L guided by the light guiding unit 113.

In addition, the image reading section 110 includes a detecting section 115 which is configured as a photoelectric conversion element such as a charge coupled device (CCD)

image sensor, or the like performing photoelectric conversion on the light L image-formed by the image forming lens 114, and detects the formed optical image, and an image processing section 116 which is electrically connected to the detecting section 115 and to which an electric signal acquired by the detecting section 115 is transmitted.

The image reading section 110 reads the image of the document transported by the document transporting section 120 and the image of the document put on the platen glass 111.

The image recording device 200 will be described.

The image recording device 200 includes an image forming section 20 which forms an image on paper, a paper supplying section 60 which supplies paper P to the image forming section 20, a paper output section 70 which outputs the paper P on which the image is formed by the image forming section 20, and a reversal transporting section 80 which reverses a front and back surface of the paper P in which the image is formed on one surface thereof by the image forming section 20 and transports the paper P again to the image forming section 20.

The image forming section 20 includes four image forming units 21Y, 21M, 21C, and 21K of yellow (Y), magenta (M), cyan (C), and black (K) which are arranged in parallel with constant intervals. Each of the image forming units 21 includes photosensitive drums 22, a charger 23 which uniformly charges a surface of the photosensitive drum 22, and a developing device 24 which develops an electrostatic latent image formed by being irradiated with laser from an optical system unit 50 (to be described later) using a preset color component toner so as to be visualized. In addition, the image forming section 20 is provided with toner cartridges 29Y, 29M, 29C, and 29K for supplying each of color toners to the developing device 24 of the image forming units 21Y, 21M, 21C, and 21K.

The image forming section 20 includes the optical system unit 50 which applies laser light to the photosensitive drums 22 of the image forming units 21Y, 21M, 21C, and 21K which are provided below the image forming units 21Y, 21M, 21C, and 21K.

The optical system unit 50 includes, in addition to a semiconductor laser (not illustrated) and a modulator, a polygon mirror (not illustrated) which deflect-scans an object with the laser light output from the semiconductor laser, a glass window (not illustrated) through which the laser light is penetrated, and a frame (not illustrated) for sealing each configuration member.

In addition, the image forming section 20 includes an intermediate transfer unit 30 which multiply transfers toner images of each colors formed in the photosensitive drums 22 of the image forming units 21Y, 21M, 21C, and 21K onto an intermediate transfer belt 31, a secondary transfer unit 40 which transfers the toner image formed to be overlapped on the intermediate transfer unit 30 onto the paper P, and a fixing device 45 which heats and presses the toner image formed on the paper P so as to be fixed.

The intermediate transfer unit 30 includes the intermediate transfer belt 31, a drive roller 32 which drives the intermediate transfer belt 31, and a tension roller 33 which gives a constant tension to the intermediate transfer belt 31.

In addition, in the intermediate transfer unit 30, plural primary transfer rollers 34 (four in exemplary embodiment) which faces the photosensitive drums 22 with the intermediate transfer belt 31 interposed therebetween, and transfers the toner image formed on the photosensitive drums 22 onto the intermediate transfer belt 31 are provided. In addition, a backup roller 35 facing a secondary transfer roller 41 to be described later through the intermediate transfer belt 31 is provided.

The intermediate transfer belt 31 receives tension by plural rotating components such as the drive roller 32, the tension roller 33, the plural primary transfer rollers 34, the backup roller 35, and a driven roller 36. Also, the intermediate transfer belt 31 is circulated and driven at a preset speed in an arrow direction by the drive roller 32 which is driven to rotate by a driving motor (not illustrated).

As the intermediate transfer belt 31, for example, a belt made of rubber or resin is used.

In addition, the intermediate transfer unit 30 includes a cleaning device 37 removing a remained toner, or the like existing on the intermediate transfer belt 31. The cleaning device 37 removes the remained toner or paper dust from the surface of the intermediate transfer belt 31 after finishing a transferring process of the toner image.

The secondary transfer unit 40 includes the secondary transfer roller 41 which is provided at a secondary transfer position, presses the backup roller 35 through the intermediate transfer belt 31 and secondary-transfers the image on the paper P. The second transfer position in which the toner image transferred on the intermediate transfer belt 31 is transferred onto the paper P is configured by the secondary transfer roller 41 and the backup roller 35 facing the secondary transfer roller 41 through the intermediate transfer belt 31.

The fixing device 45 fixes the image (toner image) on the paper P secondary-transferred by the secondary transfer roller 41, on the paper P using heat and pressure by a thermal fixing roller 46 and a pressure roller 47.

The paper supplying section 60 includes paper accommodating sections 61 which accommodate the paper on which the image is recorded, delivery rolls 62 which deliver the paper P accommodated in each of the paper accommodating sections 61, a transporting path 63 which transports the paper P delivered by the delivery roll 62, and transport rolls 64, 65, and 66 which are disposed along the transporting path 63 and transport the paper P delivered by the delivery rolls 62 onto the secondary transfer position.

The paper output section 70 includes a first loading tray 71 which is formed above the image forming section 20 and loads the paper on which the image is formed by the image forming section 20, and a second loading tray 72 which is provided between the first loading tray 71 and the image reading device 100, and loads the paper on which the image is formed by the image forming section 20.

The paper output section 70 includes a transport roll 75 which is provided at a downstream of a transporting direction further than the fixing device 45, and transports the paper P on which the toner image is fixed, and a switching gate 76 which is provided at a downstream of a transporting direction of the transport roll 75 and switches the transporting direction of the paper P.

In addition, the paper output section 70 includes a first output roll 77 at a downstream of the transporting direction of the switching gate 76, which outputs the paper P transported to one side (right side in FIG. 2) of the transporting direction switched by the switching gate 76 to the first loading tray 71.

In addition, the paper output section 70 includes a transport roll 78 which transports the paper P transported to the other side (upper side in FIG. 2) of the transporting direction switched by the switching gate 76, and a second output roll 79 which outputs the paper P transported by the transport roll 78 to the second loading tray 72, at a downstream side of the transporting direction of the switching gate 76.

The reversal transporting section 80 includes an inversion transporting path 81 at a side of the fixing device 45. In the inversion transporting path 81, the reversed paper P which is reversed by rotating the transport roll 78 in a direction opposite to a direction in which the paper P is output to the second loading tray 72. The inversion transporting path is provided with plural transport rolls 82 along the inversion transporting path 81. The paper P transported by the transport roll 82 is fed again to the secondary transfer position by the transport roll 82.

In addition, the image recording device 200 includes an apparatus main body frame 11 which supports directly or indirectly the image forming section 20, the paper supplying section 60, the paper output section 70, the reversal transporting section 80, and the control device 900, and an apparatus housing 12 (refer to FIG. 1) which is attached to the apparatus main body frame 11 and forms an exterior surface of the image forming apparatus 1.

The apparatus main body frame 11 includes the reading device supporting section 13. The reading device supporting section 13 includes the switching gate 76, the first output roll 77, the transport roll 78, the second output roll 79, and the like therein and extends in a vertical direction, and further, supports the image reading device 100. The reading device supporting section 13 supports the image reading device 100 by cooperating with a part of an inner side in the apparatus main body frame 11.

In addition, as illustrated in FIG. 1, the image recording device 200 includes a front cover 15 which is provided at a front side of the image forming section 20 as a part of the apparatus housing 12 and is mounted so as to be possible to open and close with respect to the apparatus main body frame 11.

A user is possible to change the intermediate transfer unit 30 or the toner cartridges 29Y, 29M, 29C, and 29K of the image forming section 20 into new one by opening the front cover 15.

The user interface 300 as an example of an information display means (refer to FIG. 1), for example, is a touch panel. When the user interface 300 is the touch panel, various information such as an image forming condition of the image forming apparatus 1 is displayed on the touch panel. In addition, the user performs an input operation by touching the touch panel.

In the touch panel, a back light is built-in as an example of light source for displaying, and it is attempted that visibility with respect to the user is improved by turning on the back light.

The human detecting sensor 400 detects a human approaching the image forming apparatus 1.

The image forming apparatus 1 includes plural power modes (operation mode) which have different consumption power. As the power modes, for example, a normal mode when a job is generated and the image is formed on the image recording device 200, a standby mode for waiting and preparing for a generation of the job, and a sleep mode for reducing a consumption power amount are set. In the sleep mode, the consumption power amount is reduced by stopping the power supply to the image forming section 20, or the like.

The image forming apparatus 1 shifts from the normal mode to the standby mode when finishing an image forming process by the image recording device 200. In addition, the image forming apparatus 1 shifts to the sleep mode when the job is not generated for preset time after entering the standby mode.

Meanwhile, the image forming apparatus 1 returns to the normal mode from the sleep mode when a preset returning condition is met. As the returning condition, for example, it is a time when the control device 900 receives the job. In addition, in the exemplary embodiment, the image forming apparatus 1 returns even when the human detecting sensor 400 detects a human.

In the exemplary embodiment, the human detecting sensor 400 is configured to have a pyroelectric sensor 410 to which the power is supplied even in the sleep mode and which detects the human entering a preset detection region, and a reflective sensor 420 to which the power is supplied in a case where the pyroelectric sensor 410 detects entering of the human and which detects that the human exists in the preset detection region.

The pyroelectric sensor 410 includes a pyroelectric element, a lens, an IC, a printed substrate, and the like, and detects a change amount of infrared light when the human moves. Also, the pyroelectric sensor 410 detects that the human enters when the detected change amount exceeds a preset reference value.

The reflective sensor 420 includes an infrared light emission diode which is a light emission element, and a photodiode which is a light receiving element. Also, when the human enters an inside of the detection region, the infrared light emitted from the infrared light emission diode is reflected by the human so as to be incident on the photodiode. The reflective sensor 420 detects whether or not the human exists based on a voltage output from the photodiode.

The detection region of the pyroelectric sensor 410 is set to be wider than the detection region of the reflective sensor 420. In addition, the pyroelectric sensor 410 has consumption power less than that of the reflective sensor 420.

In the exemplary embodiment, power of the pyroelectric sensor 410 is turned on even in the sleep mode, and power of the reflective sensor 420 is turned on when the pyroelectric sensor 410 detects the human.

Also, when the reflective sensor 420 detects the human within a preset time after the pyroelectric sensor 410 detects the human, a mode returns from the sleep mode to the normal mode. On the other hand, when the reflective sensor 420 does not detect the human within the preset time, the power of the reflective sensor 420 is turned off.

In such a way, the exemplary embodiment may reduce the consumption power in comparison with a configuration in which the power of the reflective sensor 420 is always turned on in the sleep mode.

In addition, the image forming apparatus 1 according to the exemplary embodiment reduces a so called erroneous detection, in which the apparatus returns from a power saving mode by erroneously detecting human who does not use the apparatus or detecting a dog, in comparison with the apparatus returning from the sleep mode when the pyroelectric sensor 410 which has a wide range of detection detects the human as a trigger. That is, the image forming apparatus 1 according to the exemplary embodiment more highly accurately detects human who has intent to use the image forming apparatus 1 and returns from the sleep mode.

The camera 500 is an example of an image capturing means, and captures an image of vicinity of the image forming apparatus 1. For example, the camera 500 includes an optical system gathers the images of vicinity of the image forming apparatus 1 and an image sensor detecting the images gathered by the optical system. The optical system is configured to have a single lens or a combination of plural lenses. The image sensor is configured to have an image capturing element such as a charge coupled device (CCD) or a complementary metal oxide semiconductor (CMOS). The camera 500 captures an image of either or both of a still image and a moving image.

The microphone 600 as an example of a voice acquiring means acquires sound of the vicinity of the image forming apparatus 1. The microphone 600 particularly acquires voice of a user who uses the image forming apparatus 1. A type of the microphone 600 is not particularly limited, and existing types such as a dynamic type or a capacitor type may also be used. However, it is preferable that the microphone 600 is a microphone of a nondirectional micro electro mechanical systems (MEMS) type.

The speaker 700 outputs the sound with respect to the vicinity of the image forming apparatus 1. The speaker 700 particularly guides the user, who uses the image forming apparatus 1, using voice. In addition, alarm sound is output to the user who uses the image forming apparatus 1. The sound output from the speaker 700 is prepared in advance as sound data. Also, for example, the sound is played from the speaker 700 based on the sound data by corresponding to a state of the image forming apparatus 1 or an operation of the user.

Next, the control device 900 will be described.

Figure 3:
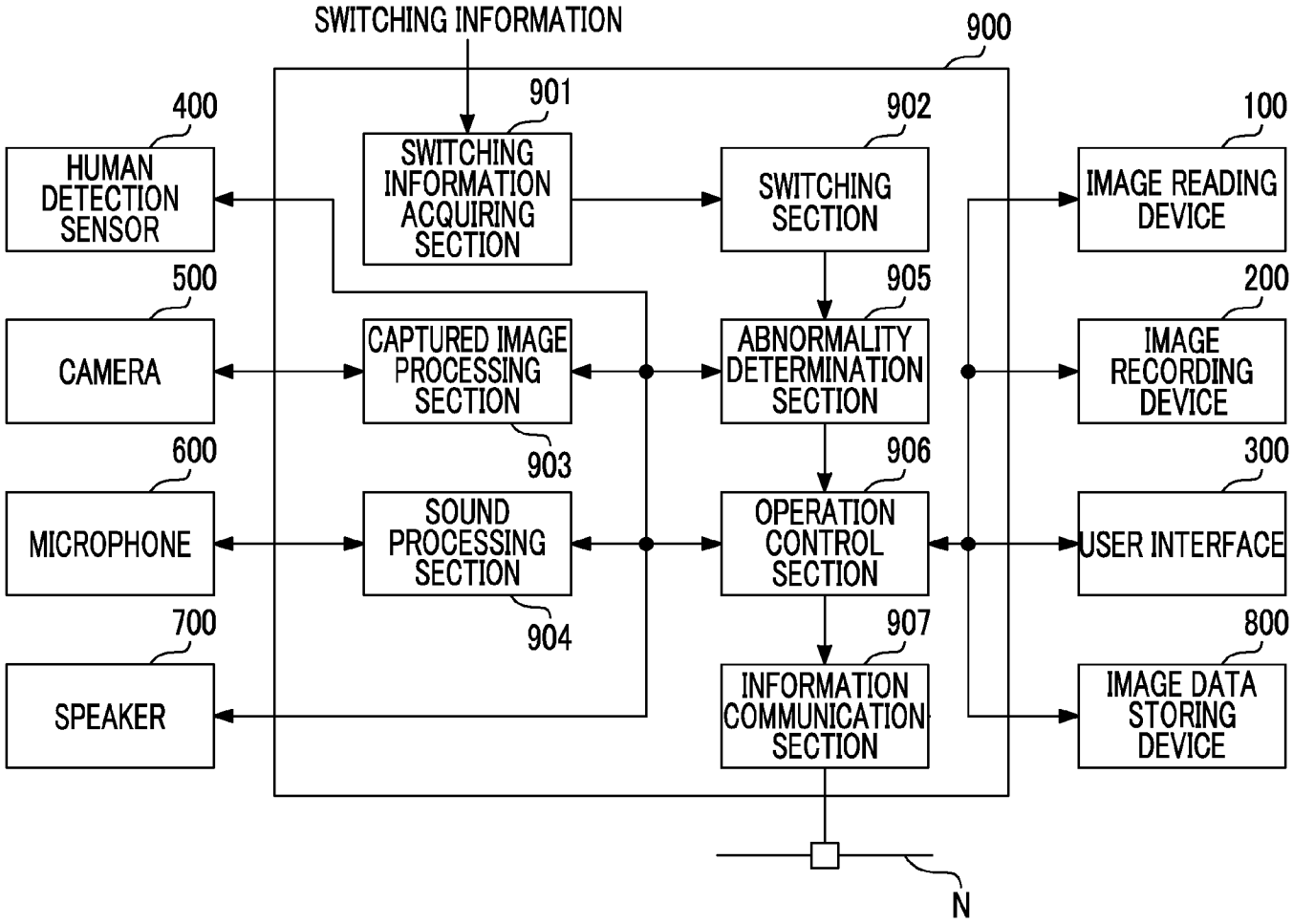
FIG. 3 is a block diagram illustrating a functional configuration example of a control device.

FIG. 3 is a block diagram illustrating an example of a functional configuration of the control device 900. Moreover, in FIG. 3, functions related to the exemplary embodiment among various functions included in the control device 900 is selected and illustrated.

The control device 900 includes a switching information acquiring section 901, a switching section 902, an captured image processing section 903, a sound processing section 904, an abnormality determination section 905, an operation control section 906, and an information communication section 907.

In the exemplary embodiment, as an operation state of the image forming apparatus 1, there are a normal state when each of mechanism sections of the image recording device 200, or the like of the image forming apparatus 1 is in the normal operation state, and a monitoring state for detecting abnormality in a preset monitoring region. That is, in the exemplary embodiment, in the monitoring state, the image forming apparatus 1 is used as a monitoring apparatus.

The switching information acquiring section 901 acquires switching information for switching the operation state of the image forming apparatus 1 into the normal state and the monitoring state.

The switching information, for example, is information in regard to luminance of vicinity of the image forming apparatus 1. That is, the vicinity of the image forming apparatus 1 is bright and illuminance thereof is great, it is considered that lighting, or the like is turned on. At this time, it is preferable that the image forming apparatus 1 is in the normal state in which an image is formed, or the like.

Meanwhile, when vicinity of the image forming apparatus 1 is dark and the illuminance thereof is less, it is considered that the lighting, or the like is turned off. At this time, the image forming apparatus 1 barely performs a normal operation in which an image is formed, or the like, and it is preferable that the image forming apparatus 1 is in the monitoring state in which the abnormality is detected in the preset monitoring region. The switching information acquiring section 901 acquires information relating to the luminance from, for example, an illumination meter (not illustrated). In this case, the illumination meter functions as a luminance detecting means detecting the luminance in the monitoring region.

The switching information is not limited to the information relating to the luminance. For example, the user may operate the user interface 300, and switches the normal state and the monitoring state. In this case, the switching information is setting information input from the user interface 300. In addition, the normal state and the monitoring state may be switched according to a date and time. For example, it is conceivable that a state thereof is set to the normal state in the weekday daytime, and is set to the monitoring state at weekday night time or holidays. In this case, the switching information is information regarding to the date and time.

Moreover, here, the monitoring region is a range in which monitoring is performed, when the image forming apparatus 1 functions as a monitoring apparatus. The monitoring region is, for example, an indoor room in which the image forming apparatus 1 is provided.

The switching section 902 is an example of the switching means which switches the operation state of the image forming apparatus 1 including the microphone 600, or the like into the normal state and the monitoring state. The switching section 902 switches the operation state of the image forming apparatus 1 based on the switching information of the luminance, or the like acquired by the switching information acquiring section 901.

The captured image processing section 903 processes the image captured by the camera 500. In the normal state, the camera 500 captures an image of a face of the user who uses the image forming apparatus 1. Also, based on the image captured by the camera 500, the captured image processing section 903 performs a user authentication.

In a situation where the image of the face of the user is recorded as the image data in advance, the user authentication is performed using the captured image processing section 903 by collating an image captured by the camera 500 and the recorded image of the face.

Meanwhile, in the monitoring state, the camera 500 captures an image of an intruder who intrudes into the monitoring region. At this time, the captured image processing section 903 stores data of the captured image. Here, in the exemplary embodiment, as illustrated in FIG. 3, an image data storing device 800 storing the image data which is an origin of the image formed by the image recording device 200 is provided. The image capturing data regarding to the monitoring region acquired by the camera 500 is stored in the image data storing device 800. Accordingly, the image capturing data is stored without a recording apparatus in single purpose for storing the image capturing data. Moreover, the image data storing device 800 is configured to have, for example, a hard disk drive (HDD).

Moreover, since the image forming apparatus 1 may be broken by the intruder, the captured image processing section 903 may transmit the captured image data to an external equipment through the information communication section 907 or a communication line N.

The sound processing section 904 processes the sound acquired by the microphone 600. In the normal state, when the user inputs the voice to the microphone 600, the sound processing section 904 performs the user authentication based on the voice acquired by the microphone 600. For example, a power spectrum which is a relationship between a frequency and strength of the voice of the user is recorded in advance, and the sound processing section 904 collates the power spectrum and a power spectrum of the voice acquired by the microphone 600.

In addition, since the user performs instruction (voice operation command) by the voice using the microphone 600, a condition of image forming in the image recording device 200 is set, or operation is started. The voice operation command is registered in advance in the dictionary for registering, and the sound processing section 904 determines an intent of the user by collating the voice of the user and contents of the dictionary for registering.

Meanwhile, in the monitoring state, the microphone 600 acquires the sound in the monitoring region. The acquired sound is used in order for the abnormality determination section 905 (to be described later) to detect the abnormality in the monitoring region.

In the monitoring state, the sound processing section 904 processes the sound in response to an abnormality determination of the abnormality determination section 905. For example, the sound processing section 904 makes the power spectrum of the sound or amplifies a sound signal.

The abnormality determination section 905 which functions as a part of an abnormality detecting means determines whether or not the abnormality is generated in the monitoring region in the monitoring state. The abnormality determination section 905 analyzes, for example, the sound (information) acquired by the microphone 600, and determines whether or not the abnormality is generated in the monitoring region.

Specifically, when voice not existing in the above described dictionary for registering is acquired by the microphone 600, the abnormality determination section 905 determines that the abnormality is generated. In addition, when the sound acquired by the microphone 600 exceeds a preset sound amount level, the abnormality determination section 905 determines that the abnormality is generated.

Further, when the sound is acquired by the microphone 600 at exceeding preset frequencies, the abnormality determination section 905 determines that the abnormality is generated. Otherwise, the abnormality determination section 905 determines that the abnormality is generated by analyzing a frequency of the sound acquired by the microphone 600. For example, since a frequency distribution has unique properties when the sound is scream, it is determined that sound acquired by the microphone 600 is scream by analyzing the frequency of the sound.

In addition, abnormal sound generated when the abnormality is generated, such as sound generated at the time of opening a door, sound generated at the time of breaking a window, or the like is registered in the dictionary for registering, and the abnormality determination section 905 may determine that the abnormality is generated when abnormal sound acquired by the microphone 600 is matched with the registered abnormal sound. In addition, the microphone 600 is provided in the plural so that a distance or a direction of a sound generating source may be acquired. Also, the abnormality determination section 905 determines whether or not the sound generating source is in the monitoring region, and it determines that the abnormality is generated when the sound generating source is in the monitoring region, and it may determine that the abnormality is not generated when the sound generating source is on the outside of the monitoring region.

In addition, other than the above described cases, the abnormality determination section 905 may determine whether or not the abnormality is generated in the monitoring region by analyzing the image data acquired by the camera 500. Here, determination whether or not the abnormality is generated may be performed by, so called difference extraction. Specifically, by comparing temporally successive two items of the image data, it is determined that the abnormality is generated when the two items of the image data are different from each other, and it is determined that the abnormality is not generated when the two items of the image data do not have a difference.

The operation control section 906 as an example of a control means controls operations of the image reading device 100, the image recording device 200, the user interface 300, the human detecting sensor 400, the camera 500, the microphone 600, and the speaker 700.

In addition, in both of the normal state and the monitoring state, the operation control section 906 determines and controls operations of the image reading device 100, the image recording device 200, the user interface 300, the human detecting sensor 400, the camera 500, the microphone 600, and the speaker 700 based on information acquired from the user interface 300, the human detecting sensor 400, the camera 500, the microphone 600, and the like.

The information communication section 907 is connected to the communication line N, and receives and transmits a signal between the information communication section 907 and the communication line N. The communication line N, for example, is a network such as a local area network (LAN), a wide area network (WAN), or Internet. In addition, the communication line N may be a public telephone line.

The information communication section 907 receives a printing job transmitted from a PC, or the like connected to the communication line N, or may be used for transmitting data of the image of the document read by the image reading device 100 to the external equipment, or the like.

Description of Operation of Image Forming Apparatus

The image forming apparatus 1 configured as described above is, for example, operated as follows.

First, operations in the normal state of the image forming apparatus 1 will be described.

In the normal state, for example, the user may copy the document using the image forming apparatus 1. In addition, the user may print by transmitting a printing job from the PC, or the like connected to the communication line N to the image forming apparatus 1. Further, receiving and transmitting of a facsimile through the communication line N may be performed. Otherwise, the user scans the document, and may store the image data thereof in the image forming apparatus 1 or the PC connected to the communication line N.

Here, a case in which the user copies the document is exemplified, and operations in the normal state of the image forming apparatus 1 will be described in detail.

When the image forming apparatus 1 is in the sleep mode, if the pyroelectric sensor 410 in the human detecting sensor 400 detects the human approaching the image forming apparatus 1, the power of the reflective sensor 420 is turned on, as described above. Also, further, when the reflective sensor 420 detects the human within preset time, the image forming apparatus 1 determines that the approaching human is a user who uses the image forming apparatus 1, such that the mode returns from the sleep mode to the normal mode.

In the normal mode, when the user looks into the camera 500, the camera 500 captures an image of a face of the user, and the control device 900 performs the user authentication.

In addition, in the normal mode, when the user inputs the voice to the microphone 600, the control device 900 performs the user authentication based on the voice acquired by the microphone 600.

Also, since the user operates the user interface 300, a condition of image forming, or the like in the image recording device 200 is set. In addition, at this time, in a case in which the number of steps are set to be great, or the like, as an auxiliary manner to the user, an instruction may be performed by inputting the voice of the user using the microphone 600. At this time, a guide thereof is output as the voice from the speaker 700, such that a conversation type may be used.

In addition, when the user operates wrongly, a guide, or the like for revising the user's wrong operation may be output from the speaker 700. Further, the speaker 700 may output a voice guide for taking out clogged paper when the paper is clogged (jammed). Further, in addition, for example, the speaker 700 is used for outputting the alarm sound to the user at the time of finishing of copying and printing, receiving facsimiles, or the like. The alarm sound may be not only beep sound, but also melody or voice.

Also, for example, when the user loads the document in the platen glass 111 of the image reading device 100 or the document accommodating section 121 and presses a start key, or the like of the user interface 300, the image of the document is read by the image reading device 100. The read image of the document is subjected to a preset image process, and the image data which is subjected to the image process is converted into color tone data of four colors of yellow (Y), magenta (M), cyan (C), and black (K), and the image is output to the optical system unit 50.

The optical system unit 50 applies the laser light emitted from a semiconductor laser (not illustrated) to a polygon mirror through a f-θ lens (not illustrated) corresponding to the input color tone data. In the polygon mirror, the incident laser light is modulated according to the tone data of each color, and subjected to deflection scanning, so as to apply the light to the photosensitive drums 22 of the image forming units 21Y, 21M, 21C, and 21K through an image-forming lens and plural mirrors (not illustrated).

In the photosensitive drums 22 of the image forming units 21Y, 21M, 21C, and 21K, a surface charged by the charger 23 is scanned and exposed, and the electrostatic latent image is formed. The formed electrostatic latent image is developed as toner images of each color of yellow (Y), magenta (M), cyan (C), and black (K) by each of the image forming units 21Y, 21M, 21C, and 21K. The toner image formed on the photosensitive drums 22 of the image forming units 21Y, 21M, 21C, and 21K is multi-transferred on the intermediate transfer belt 31 which is an intermediate transfer body.

Meanwhile, in the paper supplying section 60, the delivery roll 62 is rotated in coincide with a timing of the image forming, lifts the paper P accommodated in the paper accommodating section 61, and transports the paper P by the transport rolls 64 and 65 through the transporting path 63. After that, the transport roll 66 is rotated in coincide with a moving timing of the intermediate transfer belt 31 on which the toner image is formed, and the paper P is transported to the secondary transfer position formed by the backup roller 35 and the secondary transfer roller 41.

At the secondary transfer position, in the paper P transported from a lower portion toward an upper portion, using a pressure contact force and a predetermined electric field, the toner images in which 4 colors are overlapped is sequentially transferred in a sub-scanning direction. Also, the paper P on which the toner image of each color is transferred is output after a fixing process is performed using heat and pressure by the fixing device 45, and is loaded in the first loading tray 71 or the second loading tray 72.

When requiring a duplex printing, the paper P in which the image is formed on one surface thereof is transported to be reversed by the reversal transporting section 80, and then is transported again to the secondary transfer position. Also, in the secondary transfer position, the toner image is transferred onto other surface of the paper P, and the transferred image is fixed by the fixing device 45. After that, the paper P in which both surfaces have the images is output, and is loaded in the first loading tray 71 or the second loading tray 72.

Next, operations in the monitoring state of the image forming apparatus 1 will be described.

In the exemplary embodiment, in order to operate the image forming apparatus 1 as the monitoring apparatus, each function included in the image reading device 100, the image recording device 200, the user interface 300, the human detecting sensor 400, the camera 500, the microphone 600, and the speaker 700 is used.

First Exemplary Embodiment

First, the first exemplary embodiment will be described.

Figure 4:
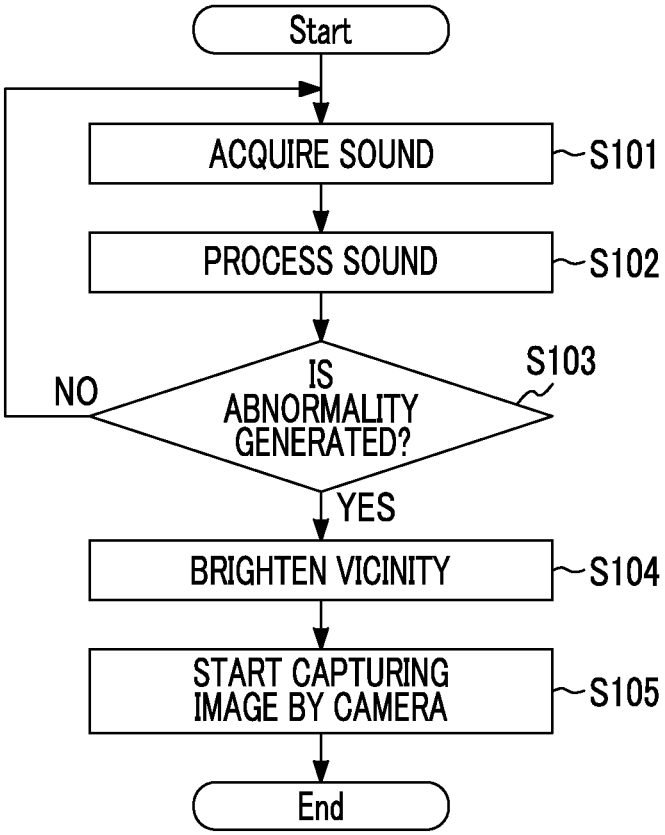
FIG. 4 is a flow chart illustrating an operation of an image forming apparatus in a first exemplary embodiment.

FIG. 4 is a flow chart illustrating an operation of the image forming apparatus 1 in the first exemplary embodiment. The image forming apparatus 1 in the monitoring state acquires the sound by the microphone 600 (Step S101). Also, the sound processing section 904 processes the sound acquired by the microphone 600 (Step S102), and the abnormality determination section 905 determines whether or not the abnormality is generated based on the sound (information) acquired by the microphone 600 (Step S103).

A process returns Step S101 when the abnormality determination section 905 determines that the abnormality is not generated (No in Step S103).

In contrast, when the abnormality determination section 905 determines that the abnormality is generated (Yes in Step S103), the operation control section 906 performs a preset operation on the image reading device 100, the image recording device 200, the user interface 300, the human detecting sensor 400, the camera 500, the microphone 600, and the speaker 700.

Here, the operation control section 906 functions as a light source controlling means, and performs an operation for brightening the vicinity of the image forming apparatus 1 (Step S104). Specifically, the light projecting unit 112 of the image reading device 100 is turned on, or backlight of the touch panel of the user interface 300 is turned on.

Moreover, when turning on the light source, both of the light projecting unit 112 and the backlight may be turned on, and either of the light projecting unit 112 or the backlight may be turned on. In addition, when the light projecting unit 112 and the backlight are turned on in advance, outputting may be increased.

In addition, for example, a mechanism switching a direction of the touch panel of the user interface 300 is provided, and touch panel may be moved in a direction in which the abnormality is generated, such as a direction in which the sound is detected.

In addition, a mechanism opening or closing the document transporting section 120 is provided, and the document transporting section 120 may be opened when determining that the abnormality is generated. In this case, when the light is much leaked from the light projecting unit 112 to the outside, the monitoring region becomes brightened.

In addition, as described later, a signal for turning on the other light source provided in the monitoring region or a signal for amplifying an output of the other light source provided are output, and the other light source may be turned on or the output thereof may be amplified. Moreover, the output of the signal is performed by the information communication section 907 which functions as a signal outputting means.

Also, the camera 500 starts capturing an image (Step S105). Accordingly, when the intruder is near the image forming apparatus 1, the camera 500 captures an image of the intruder. The captured image is stored in the image data storing device 800, as described above. Moreover, at this time, the sound is continuously acquired by the microphone 600, the sound may be stored.

Here, in the exemplary embodiment, when the camera 500 captures an image, since the light projecting unit 112 or the like is turned on, the image acquired by the camera 500 is more vivid in comparison with a case in which the light projecting unit 112 or the like is not turned on.

In the first exemplary embodiment, when the abnormality is not generated in the monitoring state, the camera 500 stops capturing an image. Also, the microphone 600 operates as the abnormality detecting means for detecting the abnormality. Also, acquiring of a motion picture is started when the abnormality is generated. That is, in the monitoring state, lighting, or the like is turned off, and the vicinity of the image forming apparatus 1 are often dark. The camera 500 is provided for recognizing, the user in the normal state, and there are many cases in which the camera 500 is used when the vicinity of the image forming apparatus 1 are brightened. Also, in this case, in a state in which the vicinity of the image forming apparatus are dark as in the monitoring state, even when the camera 500 is operated, capturing a vivid image is difficult.

In the exemplary embodiment, when the abnormality is not generated, the camera 500 stops operating, and when the abnormality is generated, the vicinity of the image forming apparatus 1 are made to be brightened. Further, in this state, more vivid image may be acquired by capturing an image using the camera 500.

In addition, in the first exemplary embodiment, in the monitoring state, when the abnormality is not generated, the camera 500 stops, and the microphone 600 operates. Consumption power of the microphone 600 is smaller than consumption power of the camera 500. Accordingly, compared to a case when the abnormality is detected using the camera 500, the power consumption is reduced.

Second Exemplary Embodiment

Next, a second exemplary embodiment will be described.

Figure 5:
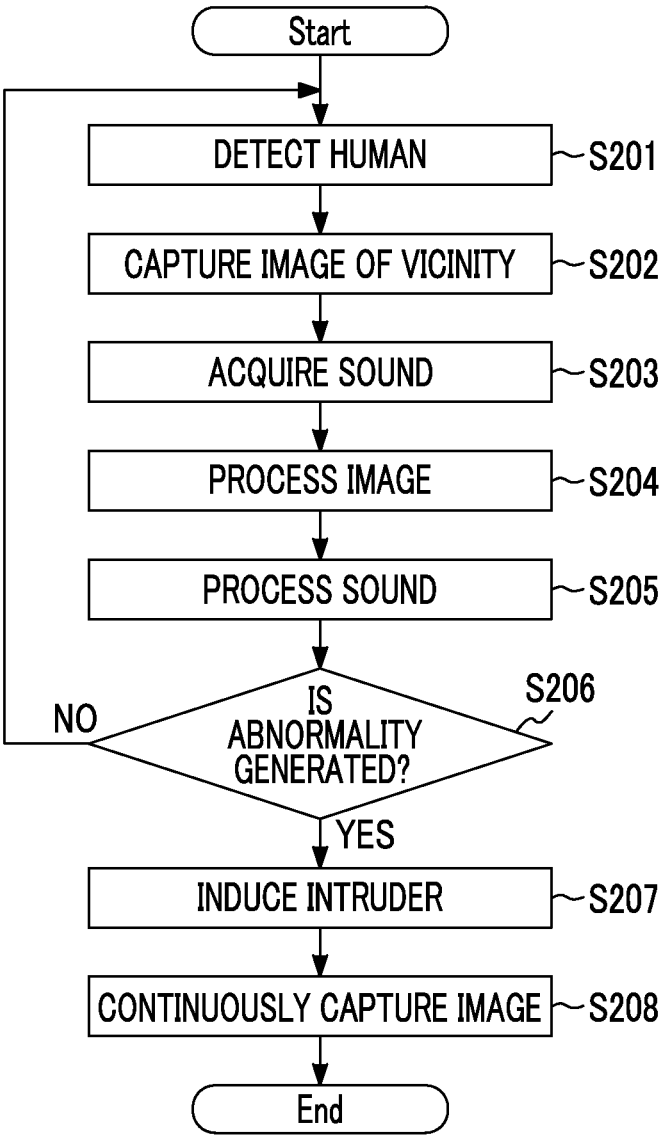
FIG. 5 is a flow chart illustrating an operation of an image forming apparatus in a second exemplary embodiment.

FIG. 5 is a flow chart illustrating an operation of the image forming apparatus 1 in the second exemplary embodiment.

In the monitoring state, the image forming apparatus 1 detects the human who enters the detection region by the pyroelectric sensor 410 of the human detecting sensor 400 (Step S201). In addition, the camera 500 captures an image of the vicinity of the image forming apparatus 1 (Step S202).

Here, in the second exemplary embodiment, the camera 500 intermittently captures images with time intervals in the monitoring state. In other words, in the exemplary embodiment, when the camera 500 does not capture an image of the user, the camera 500 intermittently captures images in the monitoring region. In this case, in comparison with a case in which the image capturing is continuously performed, a capacitance of the image data storing device 800 storing the image capturing data acquired by image capturing may be reduced. Moreover, the image capturing by the camera 500 is performed based on an instruction by the operation control section 906.

Moreover, when intermittently image capturing, in each image capturing, a still image may be acquired. In addition, in each image capturing, the image capturing is performed in a moving image mode, and the moving image may be acquired.

In addition, when intermittently image capturing, the image capturing may be performed for every preset time interval, or may be performed at a preset time. Further, image capturing may be performed, for example, when the sound of a preset condition is acquired by the microphone 600.

In addition, in the exemplary embodiment, the microphone 600 acquires the sound (Step S203). In addition, in the exemplary embodiment, the captured image processing section 903 processes the image captured by the camera 500 (Step S204). In addition, the sound processing section 904 processes the sound acquired by the microphone 600 (Step S205).

Also, the abnormality determination section 905 determines whether or not the abnormality is generated based on a detected signal from the pyroelectric sensor 410, the sound acquired by the microphone 600, and the image captured by the camera 500 (Step S206).

Moreover, the abnormality determination section 905 determines that the abnormality is generated, when the pyroelectric sensor 410 detects the human. In addition, the abnormality determination section 905 determines that the abnormality is generated, when the camera 500 captures an image of the human. Moreover, with respect to a determination whether or not the abnormality is generated, performed based on the image captured by the camera 500, for example, when comparing temporally successive two items of the image data and the two items of the image data are different from each other, it is determined that the abnormality is generated. That is, the determination is performed by a so called difference extraction.

When the abnormality determination section 905 determines that the abnormality is not generated (No in Step S206), a process returns to Step S201.

However, when the abnormality determination section 905 determines that the abnormality is generated (Yes in Step S206), the operation control section 906 performs a preset operation on the image reading device 100, the image recording device 200, the user interface 300, the human detecting sensor 400, the camera 500, the microphone 600, and the speaker 700.

Here, an operation for inducing the intruder is performed (Step S207).

Specifically, the abnormality determination section 905 performs an operation urging a manipulation to stop either or both of the sound and image displaying with respect to the intruder. For example, while outputting the alarm sound from the speaker 700, the sound such as "An intruder is detected. Please push a stop button if there is a mistake." is output. In addition, the same contents may be displayed on the touch panel of the user interface 300.

When determining that the abnormality is generated, the camera 500 continues image capturing (Step S208). Accordingly, an image of the lured intruder is captured. The captured image is stored. In addition, the sound acquired by the microphone 600 may be also stored.

Here, image capturing in Step S208 (image capturing after determining that abnormality is generated) is performed in a condition different from a condition before the abnormality is detected. Specifically, after the abnormality determination section 905 determines that the abnormality is generated, when the camera 500 captures images in the monitoring region, the operation control section 906 causes the camera 500 to capture an image in a condition different from a condition before determining that the abnormality is detected.

More specifically, the operation control section 906 causes the camera 500 to capture an image, for example, at time intervals shorter than time intervals before determining that the abnormality is generated, or causes the camera 500 to capture an image in the moving image mode. Accordingly, even after the abnormality is detected, in comparison with a case in which the image capturing is performed in a condition same as a condition before the abnormality is detected, the image capturing data (image capturing data capable of acquiring much information of intruder) for easily specifying causes of the abnormality is acquired.

Moreover, in the second exemplary embodiment, the abnormality is detected using the human detecting sensor 400, the camera 500, and the microphone 600; however, at least one of these devices may be operated, and all of them do not need to be operated. Also, when the intruder is detected, an operation luring the intruder to the image forming apparatus 1 is performed. Also, the camera 500 captures an image of the intruder coming to the image forming apparatus 1.

Third Exemplary Embodiment

Next, a third exemplary embodiment will be described.

Figure 6:
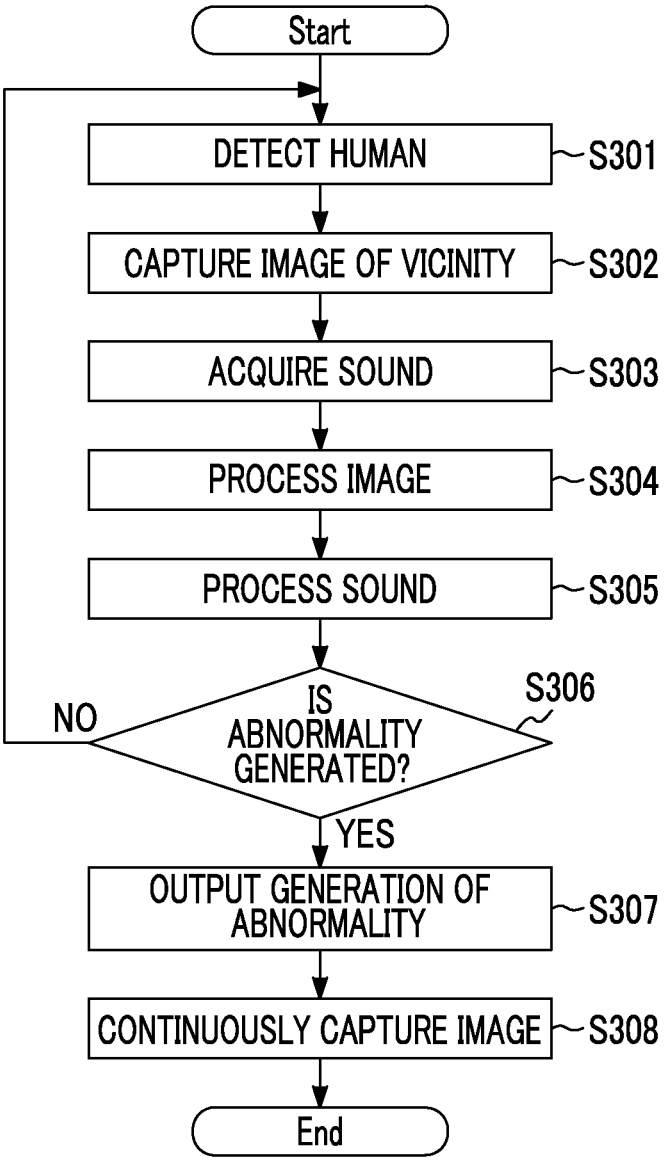
FIG. 6 is a flow chart illustrating an operation of an image forming apparatus in a third exemplary embodiment.

FIG. 6 is a flow chart illustrating an operation of the image forming apparatus 1 in the third exemplary embodiment. Moreover, Step S301 to Step S306, and Step S308 of FIG. 6 are same as Step S201 to Step S206, and Step S208 of FIG. 5, so that descriptions thereof will be omitted.

In the exemplary embodiment, when the abnormality determination section 905 determines that the abnormality is generated (Yes in Step S306), the information communication section 907 as an example of a signal outputting means outputs a fact of generation of the abnormality (Step S307). Additionally, the information communication section 907 performs a notification with respect to the outside of the image forming apparatus 1. More specifically, the information communication section 907 notifies the fact of generation of the abnormality to other equipment, and performs a cooperative operation. Here, the notification to the other equipments is performed by the information communication section 907 which functions as the signal outputting means through the communication line N.

Figure 7:
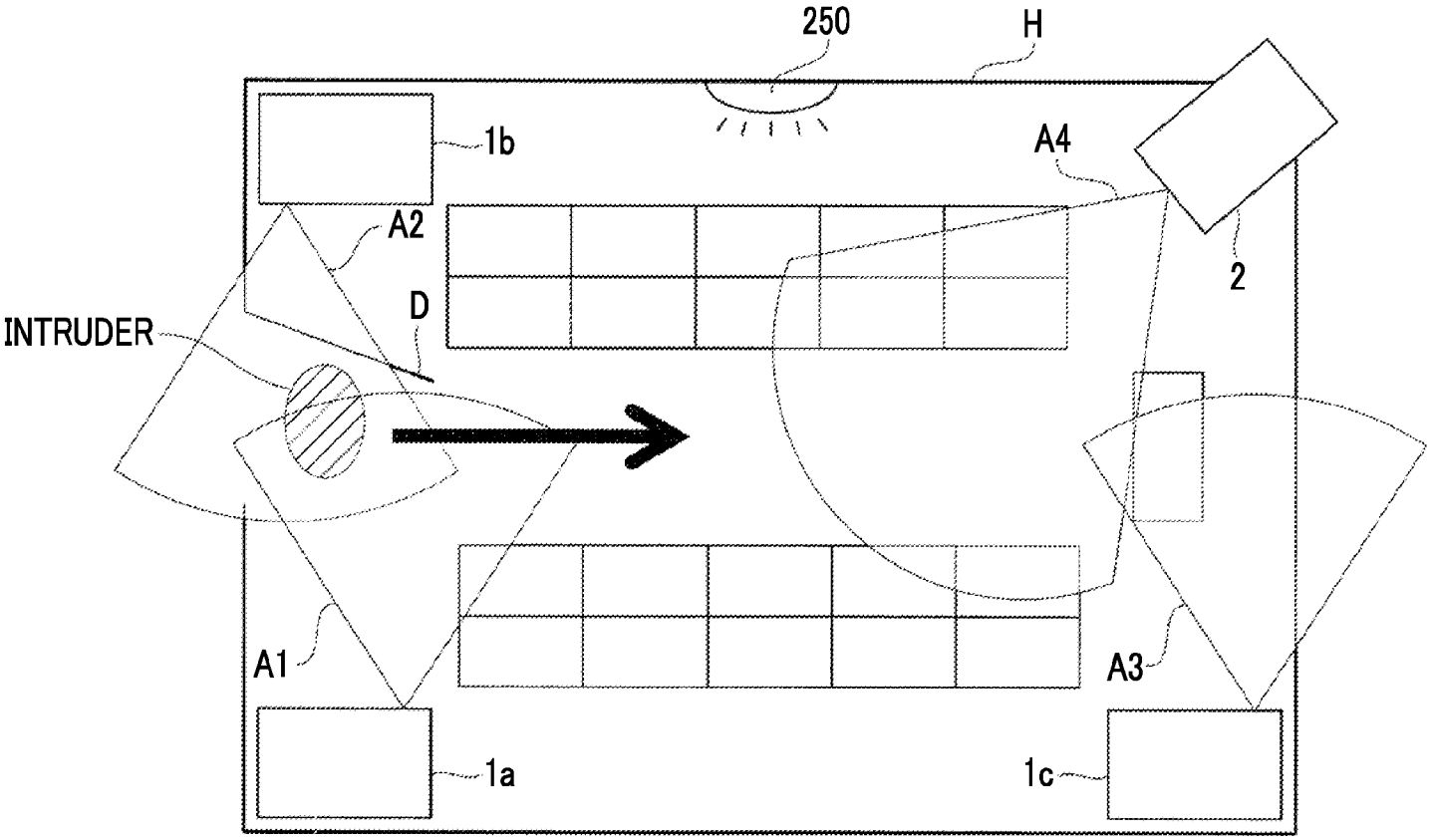
FIG. 7 is a view exemplifying a case in which a cooperative operation between the image forming apparatus and other equipment is performed.

FIG. 7 is a view exemplifying the cooperative operation between the image forming apparatus 1 and other equipments.

In FIG. 7, an image forming apparatus 1*a*, an image forming apparatus 1*b*, and an image forming apparatus 1*c* as the image forming apparatus 1 are provided at three corners among four corners of a room H. Also, a monitoring camera 2 is provided at a remained corner among the four corners of the room H. Further, a lighting 250 is provided on a wall of the room H. Moreover, the lighting control device (not illustrated) controlling the lighting 250 is provided.

The monitoring region of the image forming apparatus 1*a*, the image forming apparatus 1*b*, and the image forming apparatus 1*c* are illustrated as a monitoring region A1, a monitoring region A2, and a monitoring region A3. Further, the monitoring region of the monitoring camera 2 is illustrated as a monitoring region A4.

In this state described above, for example, it is considered that the intruder opens a door D and intrudes to the room H. At this time, since the intruder intrudes to the monitoring region A1, the image forming apparatus 1*a* detects the intruder. Moreover, the image forming apparatus 1*b* is not capable of detecting the intruder by the door D blocking. In addition, even the image forming apparatus 1*c*, or the monitoring camera 2 is not possible to detect the intruder because a position of the intruder is outside the monitoring region A3 or the monitoring region A4.

The image forming apparatus 1*a* notifies the fact of generation of the abnormality to the image forming apparatus 1*b*, the image forming apparatus 1*c*, the monitoring camera 2, and the lighting control device which are other equipments, and performs the cooperative operations thereof.

Accordingly, for example, the image forming apparatuses 1*a*, 1*b*, and 1*c* perform the operation of the first exemplary embodiment or the operation of the second exemplary embodiment as described above. In addition, the monitoring camera 2 captures the image of the intruder by changing a monitoring direction to a direction of the image forming apparatus 1*a*.

In addition, the lighting control device turns on the lighting 250. Moreover, when the lighting 250 is already turned on, outputting of the lighting increases. Accordingly, each of the monitoring regions A1, A2, and A3 included in each of the image forming apparatuses 1*a*, 1*b*, and 1*c* becomes bright. In addition, the monitoring region A4 which is monitored by the monitoring camera 2 also becomes bright.

As described above, in the exemplary embodiment, a light source (light projecting unit 112 and backlight included in lighting 250 and image forming apparatuses 1*a*, 1*b*, and 1*c*) in an installation space (room H) where the image forming apparatus 1*a* which initially detects the intruder is provided, is turned on, or, outputting is increased. Accordingly, the entire room H which is the installation space becomes bright. Accordingly, the image capturing data taken in a state in which the intruder is shown more clearly is acquired.

Here, the above described fact of generation of the abnormality which is notified from the image forming apparatus 1*a* to the lighting control device may be considered as a signal for turning on the light source increasing a light amount of the monitoring region or a signal for increasing outputting of the light source.

Moreover, here, the fact of generation of the abnormality is notified to other equipments though the communication line N; however, may be notified using an infrared communication, or the like.

In the third exemplary embodiment, the image forming apparatus 1*a*, the image forming apparatus 1*b*, and the image forming apparatus 1*c*, the monitoring camera 2, and the lighting 250 may be considered as a monitoring system.

In the monitoring system, when the intruder is detected, information relating to the intruder is further acquired by performing the cooperative operation with other equipments. In addition, in this case, the image forming apparatus 1 may be connected to an existing security system, and the existing security system is further strengthened.

In the above described first exemplary embodiment to third exemplary embodiment, an existing equipment is used in the image forming apparatus 1, and an effective use thereof is giving a function as the monitoring apparatus.

In this case, it is possible to reduce the necessity of the introduction of new equipment, and to realize a security service at a high level in lower costs.

Moreover, in the described examples, the microphone 600 is used to acquire the sound; however, it is not limited thereto. For example, an operation sound acquiring means which is disposed in the image forming apparatus 1 and acquires the operation sound of the image recording device 200 may be used.

When using the operation sound acquiring means, the abnormality determination section 905 detects the abnormality by analyzing the sound (information) acquired by the operation sound acquiring means. The operation sound acquiring means monitors the operation sound of the image recording device 200 in the normal state, and the image recording device 200 is determined to malfunction when the sound louder than the preset sound is detected. In addition, in the monitoring state, the operation sound acquiring means acquires the sound of the vicinity of the image forming apparatus 1. Also, the abnormality determination section 905 analyzes the sound (information) so that the detecting of the abnormality is performed.

In addition, detecting of the abnormality may be performed by a vibration acquiring means disposed in the image forming apparatus 1, which acquires vibration of the image recording device 200. The vibration acquiring means, in the normal state, monitors the vibration of the image recording device 200, and determines that the image recording device 200 malfunctions when the preset degree of vibration is detected. In addition, in the monitoring state, the vibration acquiring means acquires the vibration of the image forming apparatus 1, and detects the abnormality by analyzing the vibration (information).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a recording material, wherein the image forming unit includes a photosensitive drum, a charger and a developing device;

a camera that captures an image of a user who forms the image;

a controller that causes the camera to capture an image in a preset monitoring region when the user does not capture an image using the camera;

a touch panel that receives an operation input from a user or displays various information with respect to the user; and an abnormality detecting unit that detects an abnormality in the monitoring region, wherein the controller causes the camera to capture an image in a condition different from a condition before the abnormality is detected, in a case of causing the camera to capture an image in the monitoring region after the abnormality detecting unit detects the abnormality; and a lighting control unit configured to control an external lighting device, wherein when the abnormality detecting unit detects the abnormality, the touch panel is moved in a direction in which the abnormality is generated, if the external lighting device has been turned off, the lighting control unit turns on the external lighting device, and if the external lighting device has been turned on, the lighting control unit modifies lighting output of the external lighting device, wherein the controller is configured to perform the functions of the abnormality detecting unit and the lighting control unit.

2. The image forming apparatus according to claim 1, wherein the controller causes the camera to intermittently capture an image with time intervals, in a case of causing the camera to capture an image in the monitoring region when the abnormality detecting unit does not detect the abnormality.

3. The image forming apparatus according to claim 2, wherein the controller causes the camera to capture an image at time intervals shorter than time intervals before the abnormality is detected, or to capture an image in a moving image mode, in a case of causing the camera to capture an image in the monitoring region after the abnormality detecting unit detects the abnormality.

4. The image forming apparatus according to claim 3, wherein the abnormality detecting unit detects the abnormality by analyzing at least one of: (i) a voice of the user who forms the image; and (ii) operation sound of the image forming unit.

5. The image forming apparatus according to claim 4, further comprising:

a hard disk drive that stores image data which is an origin of the image formed by the image forming unit, wherein image capturing data acquired by capturing the image in the monitoring region using the camera is stored in the hard disk drive.

6. The image forming apparatus according to claim 3, further comprising:

a hard disk drive that stores image data which is an origin of the image formed by the image forming unit, wherein image capturing data acquired by capturing the image in the monitoring region using the camera is stored in the hard disk drive.

7. The image forming apparatus according to claim 2, wherein the abnormality detecting unit detects the abnormality by analyzing at least one of: (i) a voice of the user who forms the image; and (ii) operation sound of the image forming unit.

8. The image forming apparatus according to claim 7, further comprising:

a hard disk drive that stores image data which is an origin of the image formed by the image forming unit, wherein image capturing data acquired by capturing the image in the monitoring region using the camera is stored in the hard disk drive.

9. The image forming apparatus according to claim 2, further comprising:

a hard disk drive that stores image data which is an origin of the image formed by the image forming unit, wherein image capturing data acquired by capturing the image in the monitoring region using the camera is stored in the hard disk drive.

10. The image forming apparatus according to claim 1, wherein the abnormality detecting unit detects the abnormality by analyzing at least one of: (i) a voice of the user who forms the image; and (ii) operation sound of the image forming unit.

11. The image forming apparatus according to claim 10, further comprising:

a hard disk drive that stores image data which is an origin of the image formed by the image forming unit, wherein image capturing data acquired by capturing the image in the monitoring region using the camera is stored in the hard disk drive.

12. The image forming apparatus according to claim 1, wherein the abnormality detecting unit detects the abnormality by analyzing an image acquired by capturing the image in the monitoring region using the camera.

13. The image forming apparatus according to claim 12, further comprising:

a hard disk drive that stores image data which is an origin of the image formed by the image forming unit, wherein image capturing data acquired by capturing the image in the monitoring region using the camera is stored in the hard disk drive.

14. The image forming apparatus according to claim 1, further comprising:

a hard disk drive that stores image data which is an origin of the image formed by the image forming unit, wherein image capturing data acquired by capturing the image in the monitoring region using the camera is stored in the hard disk drive.

15. The image forming apparatus according to claim 1, wherein the lighting control unit modifies the lighting output of the external lighting device by increasing the lighting output of the external lighting device.

* * * * *